US006732677B2

(12) United States Patent
Donnelly et al.

(10) Patent No.: US 6,732,677 B2
(45) Date of Patent: May 11, 2004

(54) BRACKET FOR WATER HEATER

(75) Inventors: Donald Donnelly, Fenton, MO (US); James Ferguson, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/271,366

(22) Filed: Oct. 15, 2002

(65) Prior Publication Data

US 2004/0069246 A1 Apr. 15, 2004

(51) Int. Cl.[7] ..... F22B 37/42

(52) U.S. Cl. ..... 122/504; 431/343; 126/351

(58) Field of Search ..... 122/4 R, 493, 122/504, 504.1; 126/351; 392/455; 136/217, 219; 374/179, 208; 248/690, 220.21, 225.11, 226.11, 226.12; 431/343

(56) References Cited

U.S. PATENT DOCUMENTS 3,652,195 A 3/1972 McIntosh et al.
3,908,898 A * 9/1975 Dykzeul ..... 236/21 B
4,089,632 A * 5/1978 Rexroad ..... 431/21
4,830,515 A * 5/1989 Cortes ..... 374/208
4,924,816 A * 5/1990 Moore et al. ..... 122/17.1
5,312,036 A * 5/1994 Trotter ..... 236/21 B
5,941,200 A * 8/1999 Boros et al. ..... 122/14.22
6,371,057 B1 * 4/2002 Henderson ..... 122/14.2
6,666,421 B2 * 12/2003 Hueser ..... 248/229.26
2001/0042564 A1 11/2001 Abraham et al.

* cited by examiner

*Primary Examiner*—Gregory A. Wilson
(74) *Attorney, Agent, or Firm*—Harness, Dickey & Pierce, P.L.C.

(57) ABSTRACT

A bracket for use in mounting a safety switch in series with a thermocouple provides improved positioning of the switch to detect conditions causing safety concerns. The bracket includes adjustable support members for providing connection of the safety switch to a thermocouple and maintaining the position of the safety switch for improved detection. The bracket provides for mounting the safety switch connected in series to the thermocouple within a water heater for detection of overheat conditions.

22 Claims, 5 Drawing Sheets

BRACKET FOR WATER HEATER

FIELD OF THE INVENTION

This invention relates generally to residential water heaters, and more particularly to a bracket for use in mounting a safety switch in series with a thermocouple in a water heater.

BACKGROUND OF THE INVENTION

A residential water heater, and in particular a gas-fired water heater uses a gas burner to heat water within the tank of the hot water heater. A thermostat is typically provided to control the temperature of the water inside the tank and typically may be set within a particular range (e.g., warm, hot or very hot). In order to ignite the burner, either for the first time or if the burner flame goes out, a pilot flame is used to provide that ignition. Further, gas water heaters typically include a thermocouple device to detect whether a flame is present. The heat of the flame creates a current in the thermocouple that keeps a gas valve open. When the flame goes out, the circuit is broken (i.e., no current flow through the thermocouple), causing the gas valve to close.

Recently gas water heaters have also incorporated safety devices, including energy cutoff switches (ECO), which detect excessive heat conditions and open the switch to provide an open circuit to thereby close the gas valve. In particular, the ECO is connected in series with the thermocouple so that it interrupts the current flow keeping the gas valve open, causing the gas valve to close, when excessive heat is detected. Thus, ECO switches for use with hot water heaters interrupt the electrical current flow from the thermocouple and cause the burner and pilot flame to extinguish during conditions of excessive heat.

It has been difficult to incorporate ECOs and other similar sensors into hot water heaters because of the necessity that they be connected in series with the thermocouple. This necessity makes it difficult to position the ECO in the best place to detect excessive heat conditions and therefore reduces the effectiveness and reliability of the ECO. Further, assemblies for use in attempting to connect and mount these ECOs in a good location for detecting excessive heat conditions are, very specialized (e.g., manufactured for a particular application or hot water heater), which results in added cost to manufacture such assemblies.

SUMMARY OF THE INVENTION

The present invention relates to a bracket for mounting a thermocouple and safety device (e.g., ECO), and to a thermocouple and safety device (e.g., ECO) assembly that positions the thermocouple and the safety device while also providing connection of the safety device in series with the thermocouple. In particular, the present invention provides a bracket that supports the safety device and connects to the outer portion of a conductor of a standard thermocouple to provide grounding, while allowing the inner portion of the conductor to be connected in series with, for example, a thermally actuated safety switch, such as an ECO switch. Thus, mounting of the bracket in a particular desired location in the gas fired appliance (e.g., hot water heater) is provided.

Specifically, in one embodiment of the present invention a bracket for mounting a safety switch (e.g., ECO) in connection with a thermocouple of a water heater includes a first and second support member for maintaining the position of the safety switch in connection with the thermocouple, and a mounting portion for mounting the bracket to a hot water heater. The support members may be configured for adjustment for use in supporting the thermocouple thereto and/or to allow for connection of the safety device in series with the thermocouple. Further, the bracket may provide continuous electrical connection through the thermocouple when connected in series with the safety device.

In another embodiment of the present invention a bracket for mounting a safety switch in connection with a thermocouple includes means for connecting the safety switch to the thermocouple to provide continuous electrical connection and grounding through the thermocouple and configured to maintain the position of the safety switch. The bracket also includes means for mounting the bracket within a water heater.

In still another embodiment of the present invention a combined thermocouple and ECO assembly for a water heater includes a thermocouple having a conductor with internal and external leads divided into proximal and distal sections and a bracket having first and second portions engaging and electrically connecting the leads to provide electrical connection between the external leads of the proximal and distal sections. Further, the ECO includes first and second leads connected between the internal leads of the proximal and distal sections. The first and second portions may be configured for adjustable engagement.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 2(*b*) is an elevation view of another embodiment of a bracket of the present invention;

DETAILED DESCRIPTION OF THE PREFERRED EMBODIMENTS

The following description of the preferred embodiments is merely exemplary in nature and is in no way intended to limit the invention, its application, or uses. Although the present invention is described in connection with a bracket having a particular configuration for mounting a specific safety device for a gas fired appliance, it is not so limited, and different configurations may be provided to mount different safety devices.

Figure 1:
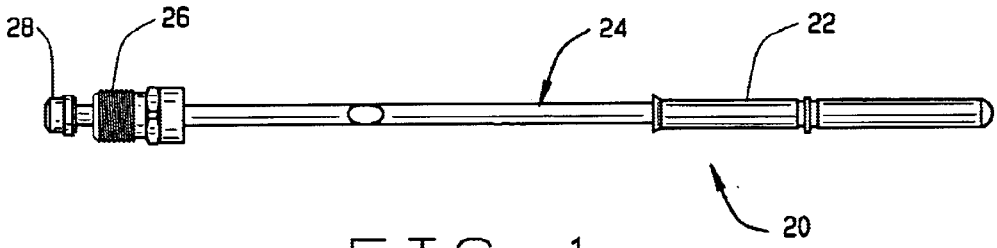
FIG. 1 is an elevation view of an exemplary thermocouple.

Before describing in detail a bracket of the present invention, a brief description of a thermocouple for use with a gas fired application, such as a hot water heater, will be provided. As shown in FIG. 1, a typical thermocouple 20 includes a tip 22 and an integrated conductor 24 (e.g., connection wires) to provide electrical connection to the coil operator of, for example, a hot water heater. Typically the conductor 24 includes an outer portion that provides ground and an inner portion that is connected to dissimilar materials in the tip 22 that generate an electric flow when exposed to heat. The thermocouple 20 develops a voltage when heated based upon the thermoelectric properties of the two electrically connected portions of dissimilar composition. Essentially, the heat creates an electron flow from the one material to the other in the tip 22. Electrical current is thereby provided through the conductor 24 that is connected to the coil operator in the gas valve of the hot water heater to thereby activate the operator to provide a supply of gas (i.e., open the gas supply valve). When connected to the coil operator using threads 26, as shown in FIG. 1, the threads 26 provide an electrical ground and a connection member 28, which is electrically connected to the inner portion, provides current flow.

In operation, and for example, when igniting a hot water heater, the electrical current generated from the tip 22 of the thermocouple 20 when heated by a pilot flame creates an electromagnetic field which magnetically holds in an open position a rubber valve member to provide gas flow to the burner of the hot water heater. The pilot flame is typically initiated by manually depressing a valve and igniting the pilot flame, and holding the valve until the thermocouple 20 is heated to a certain temperature (i.e., until electrical current flows through the tip 22).

Having described an exemplary thermocouple 20 for use with a hot water heater, a bracket of the present invention will now be described that may be used for mounting a safety device, and in particular, an ECO in series with the thermocouple 20. The ECO may be, for example, a re-settable thermal switch, part number C01-150 .25-0011 available from Thermik corporation. It should be noted that the bracket may be used for initial installation of an ECO or for retrofit applications. Specifically, and as shown in FIGS. 2 through 7, a bracket 30 of the present invention generally includes first and second support members 32 and 34 for supporting an ECO mounted in series with a thermocouple 20, and a mounting portion 36 for mounting the bracket 30 within the hot water heater. In particular, the support members 32 and 34 are integrally formed, as part of a longitudinally extending base portion 38 for supporting the conductor 24 of the thermocouple 20. Support members 32 and 34 are preferably configured for crimping and/or rolling to provide for support of an ECO in a gap 40, which allows for further adjustment of the position of an attached ECO. The support members 32 and 34 essentially create a channel 42 for passage therethrough of the conductor 24 of the thermocouple 20.

Figure 2A:
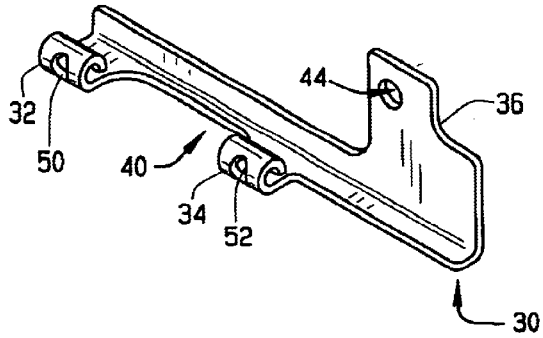
FIG. 2(*a*) is a top perspective view of a bracket constructed according to the principles of the present invention for mounting a safety device within a gas-fired appliance.
Figure 2B:
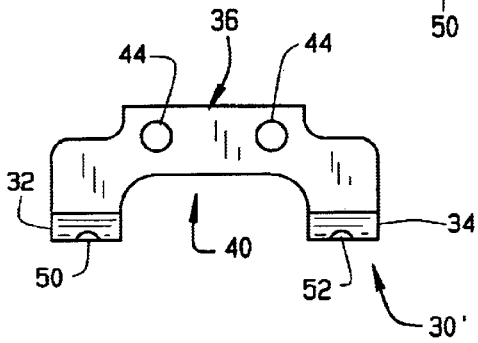
Figure 3:
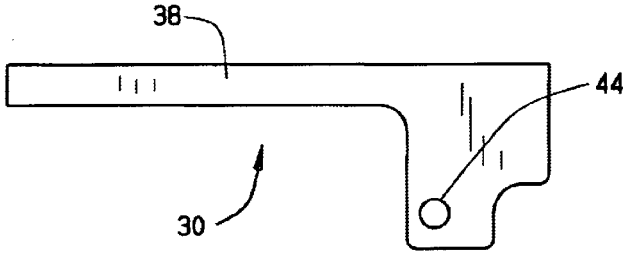
FIG. 3 is a rear elevation view of the bracket of FIG. 2(*a*)
Figure 4:
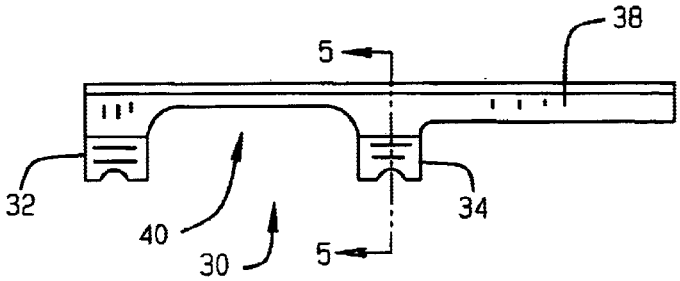
FIG. 4 is a top plan view of the bracket of FIG. 2(*a*)
Figure 5:
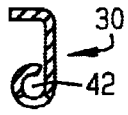
FIG. 5 is a cross-sectional view of the bracket of FIG. 4 taken along the line 5—5.
Figure 6:
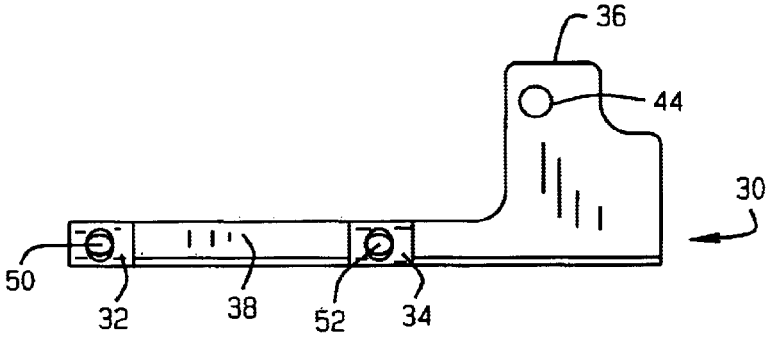
FIG. 6 is a front elevation view of the bracket of FIG. 2(*a*)
Figure 9:
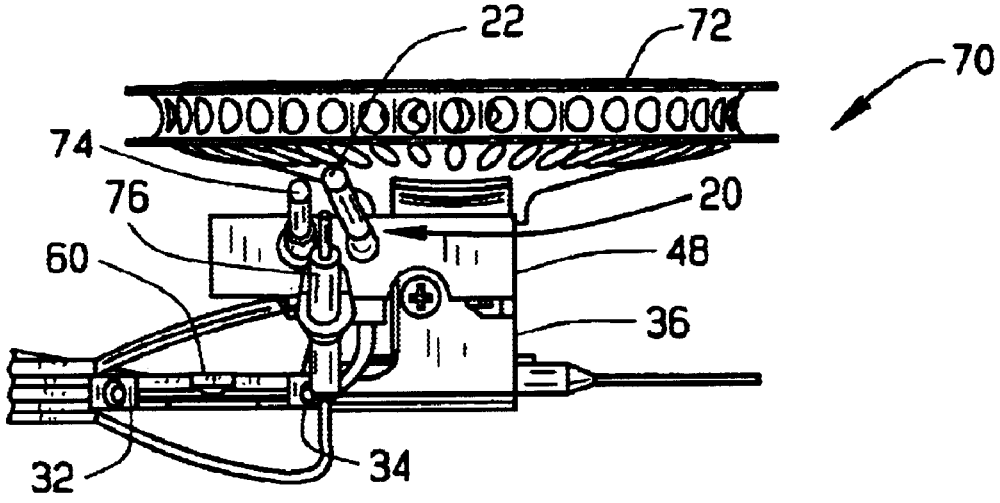
FIG. 9 is a front perspective view of the bracket of FIG. 2(*a*) connected to a burner unit.
Figure 10:
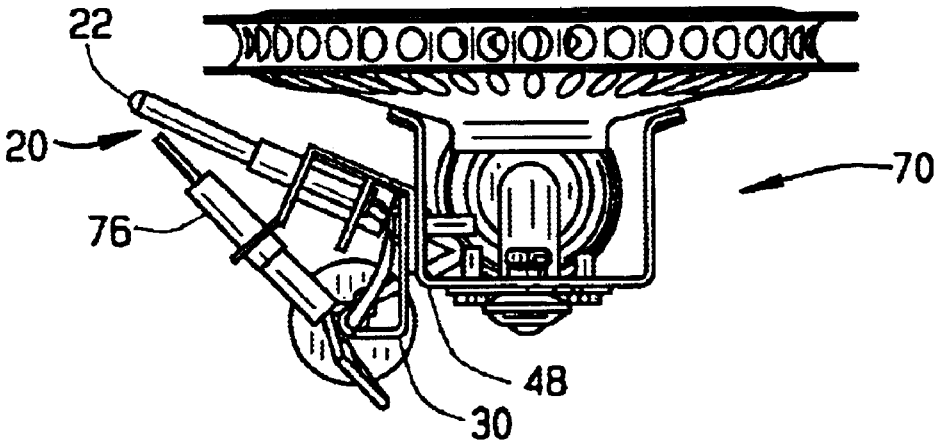
FIG. 10 is a side perspective view of the bracket of FIG. 2(*a*) connected to a burner unit.
Figure 12:
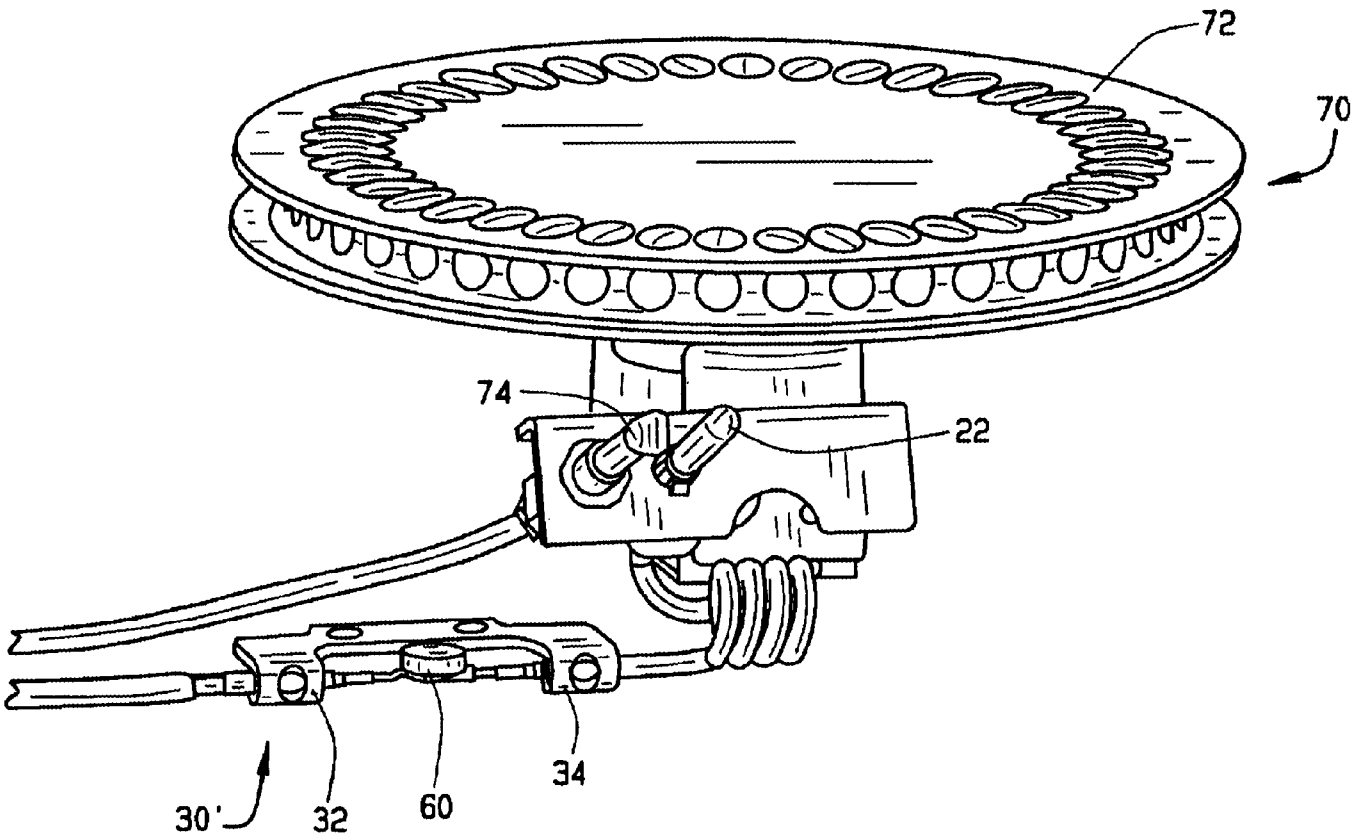
FIG. 12 is a top perspective view of the bracket of FIG. 2(*b*) in connection with a burner unit.

As shown in one embodiment in FIG. 2(*a*), the mounting portion 36 is configured as a tab offset from the center of the bracket 30 and extending vertically and perpendicular from the base portion 38 and includes a mounting hole 44 for mounting the bracket 30 to a hot water heater, for example, to an existing standard pilot burner/thermocouple bracket 48 as shown in FIGS. 9 and 10. In another embodiment, and as shown in FIG. 2(*b*), a bracket 30' may be provided with the mounting portion 36 provided at about the center of the bracket 30' and includes two mounting holes 44 for mounting the bracket 30' to a hot water heater as shown in FIG. 12. Further, and as shown in FIG. 2(*b*), the mounting bracket 30' may be provided without the longitudinally extending base portion 38 extending through the gap 40.

It should be noted that the brackets 30 and 30' may be mounted in any location within the hot water heater and are not limited to a particular location. Further, and as shown for example in FIG. 12, the bracket 30' may be used to connect an ECO 60 in series with a thermocouple 20 without mounting the bracket 30' within the hot water heater. In such as case, the thermocouple 20 supports the bracket 30'. The bracket 30 may also be used in this manner. The brackets 30 and 30' are preferably mounted in a location to allow for detection of overheat conditions by the ECO.

Figure 7:
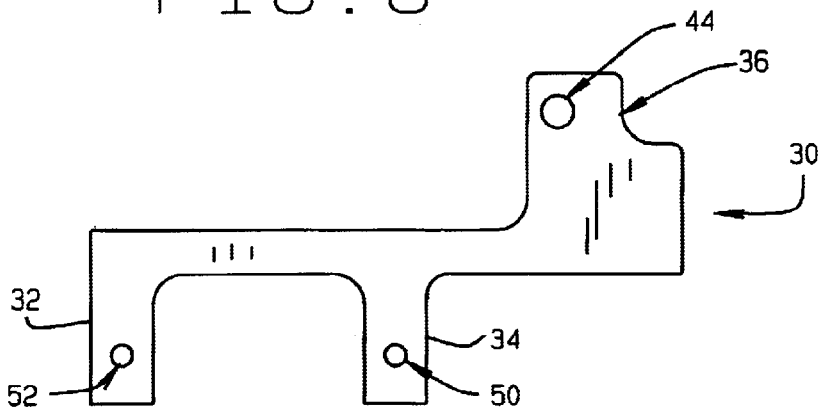
FIG. 7 is a side elevation view of the bracket of FIG. 2(*a*) showing the support members in an uncrimped position.

As shown in FIG. 7, the bracket 30 may be constructed as a single stamped piece (e.g., metal stamp bracket) with the support members 32 and 34 crimped or formed to accommodate a particular size of conductor 24 for a specific thermocouple 20.

Figure 8:
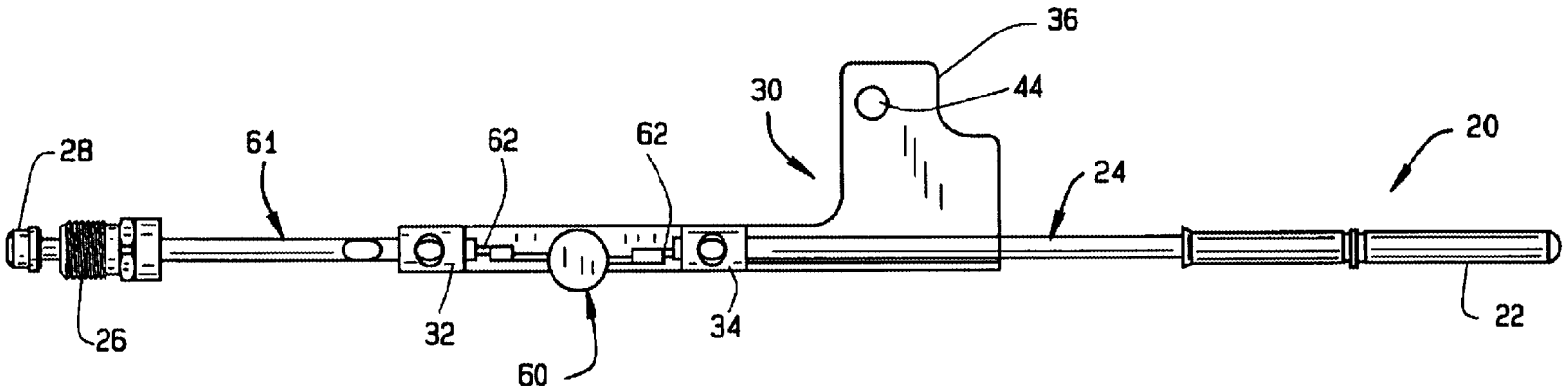
FIG. 8 is an front elevation view of the bracket of FIG. 2(*a*) showing a safety device connected in series with a thermocouple.
Figure 11:
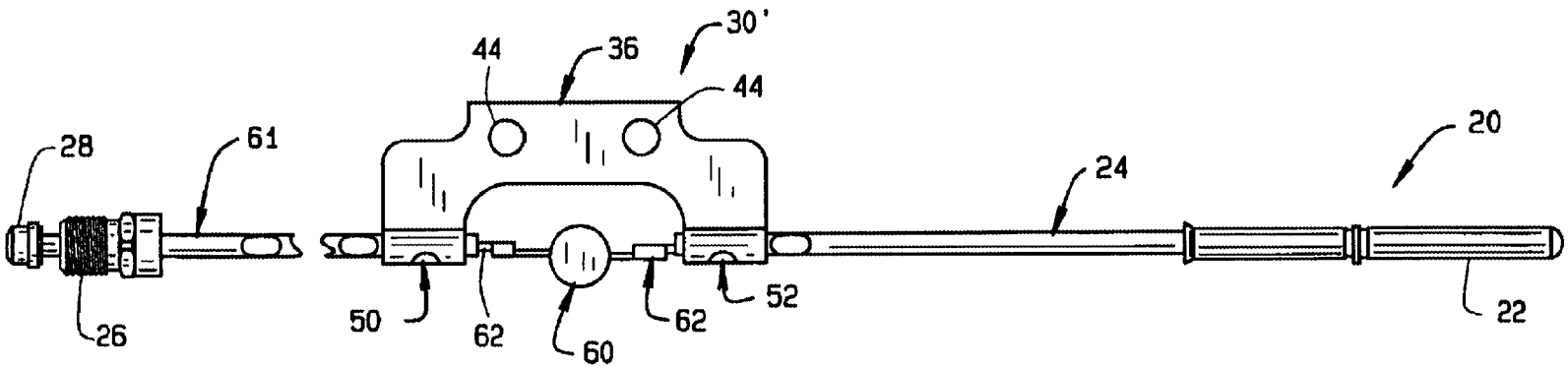
FIG. 11 is a back plan view of the bracket of FIG. 2(*b*) showing a safety device connected in series with a thermocouple.

In operation, and as shown more specifically in FIGS. 8 and 11, the brackets 30 and 30' of the present invention provide support for mounting an ECO 60 in series with a thermocouple 20, thereby maintaining continuous electrical connection through the thermocouple 20. In particular, the ECO 60 is connected to an inner portion 62 of the conductor 24, to provide electrical flow. Further, the bracket 30 provides continuous electrical grounding of the outer portion 61 of the conductor 24 using the threads 26. It should be noted that the support members 32 and 34 may be provided with openings 50 and 52 which may be used, for example, for injecting solder to connect the outer portion 61 to the support members 32 and 34.

As shown in FIGS. 9, 10 and 12, the brackets 30 and 30' allow for mounting of an ECO 60 in series with a thermocouple 20 within a hot water heater and in particular, the burner unit 70 of a hot water heater. For example, and as shown in FIG. 9, the bracket 30 may be mounted to a standard pilot burner/thermocouple bracket 48 below the burner 72 of the hot water heater. In particular, the ECO is connected (e.g., spliced) in series with the thermocouple 20 and mounted in close proximity to and below the thermocouple tip 22 and burner 72 to detect overheat conditions. Further, and as shown in FIG. 9, the ECO also may be mounted below a pilot gas flow tube 74 and a gas igniter, which may be, for example, a hot surface igniter 76. Thus, and for example, if air flow is restricted to the burner 72 and flames begin to turn downward, and/or lint below the burner and/or vapor begins to ignite, the ECO 60 is mounted in a location to detect such overheat condition and shut off the burner 72 (i.e., shut off the burner flame).

Thus, the present invention provides a simpler, less costly bracket for mounting an ECO within a hot water heater in a desired location. The present invention allows for adjustment of the mounted ECO and provides for ease in retrofit installations.

The description of the invention is merely exemplary in nature and, thus, variations that do not depart from the gist of the invention are intended to be within the scope of the invention e invention. Such variations are not to be regarded as a departure from the spirit and scope of the invention.

What is claimed is:

1. A bracket for mounting a safety switch in connection with a thermocouple of a water heater, the bracket comprising:

a first and second support member for maintaining the safety switch positioned between the support members in connection with the thermocouple; and a mounting portion for mounting the bracket to a hot water heater.

2. The bracket according to claim 1 wherein the safety switch comprises an energy cutoff switch.

3. The bracket according to claim 1 wherein the support members are configured for adjustment for use in supporting the thermocouple thereto.

4. The bracket according to claim 1 wherein the support members comprise an opening for use in injecting therethrough a substance for securing an outer portion of the thermocouple to the support members.

5. The bracket according to claim 1 wherein the support members are configured to allow for connection of the safety device in series with the thermocouple.

6. The bracket according to claim 5 wherein the supports members are configured to provide a continuous ground through the thermocouple when connected in series with the safety device.

7. The bracket according to claim 6 wherein the supports members are configured to provide continuous electrical connection through the thermocouple when connected in series with the safety device.

8. The bracket according to claim 1 further comprising a gap portion between the first and second support members for connecting the safety device therebetween.

9. The bracket according to claim 1 wherein the mounting portion is configured for mounting to a pilot burner/thermocouple bracket.

10. An improved bracket for use in mounting a safety switch in connection with a thermocouple, the improvement comprising support members to support the safety switch between the support members and connected in series with the thermocouple and configured to provide continuous electrical connection and grounding within the thermocouple.

11. The improved bracket according to claim 10 wherein the safety switch comprises an energy cutoff switch.

12. The improved bracket according to claim 10 wherein the support members are configured for adjustment for supporting different size thermocouples connected therewith.

13. A bracket for mounting a safety switch in connection with a thermocouple comprising:

means for connecting the safety switch to the thermocouple to provide continuous electrical connection and grounding through the thermocouple and configured to maintain the position of the safety switch in a gap relative to the thermocouple; and means for mounting the bracket within a water heater.

14. A combined thermocouple and ECO assembly for a water heater, the assembly comprising a thermocouple and an ECO, the thermocouple having outer and inner conductor portions, the ECO spliced to the inner conductor portion; the assembly further comprising a bracket having first and second portions engaging the outer conductor portion to complete an electrical connection through the outer conductor portion.

15. The combined thermocouple and ECO assembly according to claim 14 wherein the first and second portions are configured for adjustable engagement.

16. The combined thermocouple and ECO assembly according to claim 14 wherein the bracket is configured for connection to a pilot burner/thermocouple bracket.

17. A method of mounting a safety switch in connection with a thermocouple within a water heater comprising:

providing connection for the safety switch in series with the thermocouple to allow continuous electrical flow and grounding through the thermocouple connected to the safety switch;

supporting the safety switch in a fixed position after connection to the thermocouple; and providing for mounting of the safety switch connected to the thermocouple within the water heater.

18. The method according to claim 17 further comprising providing adjustable support members for connecting the safety switch in series with the thermocouple and supporting the safety switch.

19. The method according to claim 17 wherein the safety switch comprises an ECO.

20. The method according to claim 19 further comprising allowing for splicing of the ECO to the thermocouple to provide the connection.

21. A bracket for mounting a safety switch in connection with a thermocouple of a water heater, the bracket comprising:

a first and second support member for maintaining the position of the safety switch in connection with the thermocouple; and a mounting portion for mounting the bracket to a hot water heater;

wherein the support members comprise an opening for use in injecting therethrough a substance for securing an outer portion of the thermocouple to the support members.

22. A bracket for mounting a safety switch in connection with a thermocouple of a water heater the bracket comprising:

a first and second support member for maintaining the position of the safety switch in connection with the thermocouple;

a mounting portion for mounting the bracket to a hot water heater; and a gap portion between the first and second support members for connecting the safety device therebetween.

* * * * *